US007282673B2

(12) United States Patent
Sung et al.

(10) Patent No.: US 7,282,673 B2
(45) Date of Patent: Oct. 16, 2007

(54) COOKING APPARATUS

(75) Inventors: Han Jun Sung, Yongin-Si (KR); Dae Sung Han, Hwasung-Si (KR); Yong Hyun Kwon, Suwon-Si (KR); Tae Uk Lee, Suwon-Si (KR); Seong-Deog Jang, Suwon-Si (KR); Pung Yeun Cho, Suwon-Si (KR); Han Seong Kang, Hwasung-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/377,206

(22) Filed: Mar. 17, 2006

(65) Prior Publication Data

US 2007/0095813 A1 May 3, 2007

(30) Foreign Application Priority Data

Oct. 31, 2005 (KR) ..... 10-2005-0103253

(51) Int. Cl.
*A21B 1/26* (2006.01)

(52) U.S. Cl. ..... 219/400; 126/21 A; 99/475

(58) Field of Classification Search ..... None
See application file for complete search history.

(56) References Cited

U.S. PATENT DOCUMENTS

2003/0079736 A1* 5/2003 Franzolin et al. ..... 126/21 A
2004/0040950 A1* 3/2004 Carbone et al. ..... 219/400
2004/0200362 A1* 10/2004 Leppich et al. ..... 99/476

FOREIGN PATENT DOCUMENTS

JP 09-126463 5/1997
JP 11-325478 A * 11/1999

* cited by examiner

*Primary Examiner*—Joseph M. Pelham
(74) *Attorney, Agent, or Firm*—Staas & Halsey LLP

(57) ABSTRACT

A cooking apparatus to effectively agitate and evenly distribute high-temperature air into a cooking chamber by use of a single driving fan and a plurality of driven fans. The cooking apparatus includes the cooking chamber, the driving fan arranged at a rear wall of the cooking chamber, a convection heater to surround the driving fan, the plurality of driven fans arranged on a circumference of the driving fan, and a fan cover having a plurality of suction holes and discharge holes. The driving fan is connected with a drive motor to rotate in accordance with an operation of the drive motor. The driven fans rotate by use of air streams generated when the driving fan rotates. The high-temperature air is evenly agitated in accordance with the rotation of the driven fans to be distributed into the cooking chamber via the discharge holes in all directions.

18 Claims, 6 Drawing Sheets

COOKING APPARATUS

CROSS-REFERENCE TO RELATED APPLICATIONS

This application claims the benefit of Korean Patent Application No. 2005-103253, filed on Oct. 31, 2005 in the Korean Intellectual Property Office, the disclosure of which is incorporated herein by reference.

BACKGROUND OF THE INVENTION

1. Field of the Invention

The present invention relates to a cooking apparatus. More particularly, to a cooking apparatus in which a single driving fan and a plurality of driven fans are provided to effectively agitate high-temperature air, whereby the high-temperature air is evenly distributed into the overall space of a cooking chamber.

2. Description of the Related Art

Generally, a conventional cooking apparatus includes a heater and a blowing fan. When the blowing fan suctions air inside a cooking chamber, the heater heats the suctioned air to high-temperature air. After that, the blowing fan discharges the high-temperature air into the cooking chamber. As this air suction, heating, and discharge procedure is repeatedly performed, food placed in the cooking chamber is cooked.

An example of conventional cooking apparatuses is disclosed in Japanese Patent Laid-Open Publication No. 1997-126463. The conventional cooking apparatus is designed to reduce a temperature difference inside a cooking chamber. Two blowing fans and two heaters are mounted at an outside of a side wall and a rear wall of the cooking chamber, respectively. The air inside the cooking chamber is suctioned and again discharged in a high-temperature state via the side wall and the rear wall of the cooking chamber, whereby food placed in the cooking chamber is cooked.

In the conventional cooking apparatus having the above-described configuration, a rapid cooking of food is possible and a temperature distribution in the cooking chamber is relatively even since food is cooked by the high-temperature air supplied from both the adjacent walls of the cooking chamber.

However, the conventional cooking apparatus has a problem in that it consumes excessive energy since the two blowing fans are operated by use of different motors to reduce the temperature difference in the cooking chamber. Further, based upon the asymmetric structure of the conventional cooking apparatus in which the two blowing fans are arranged adjacent to each other, it is impossible to achieve a completely even temperature distribution in the cooking chamber.

SUMMARY OF THE INVENTION

Accordingly, it is an aspect of the present invention to provide a cooking apparatus in which a single driving fan and a plurality of driven fans are provided to effectively agitate high-temperature air, whereby the high-temperature air can be evenly distributed into the overall space of a cooking chamber.

Additional aspects and/or advantages of the invention will be set forth in part in the description which follows and, in part, will be apparent from the description, or may be learned by practice of the invention.

The foregoing and/or other aspects of the present invention are achieved by providing a cooking apparatus including a cooking chamber to cook food therein, a driving fan arranged at a wall of the cooking chamber, and one or more driven fans arranged on a circumference of the driving fan.

The driving fan is located at a center of a rear wall of the cooking chamber, and the driven fans are spaced apart from the driving fan by a predetermined distance.

The cooking apparatus further including a drive motor, wherein the driving fan is connected with the drive motor which is installed at an outside of the rear wall of the cooking chamber, to rotate in accordance with an operation of the drive motor, and the driven fans are supported at the rear wall of the cooking chamber by use of bearing members, respectively, to rotate by air streams generated when the driving fan rotates.

The cooking apparatus further includes a fan cover to enclose the driving fan and the driven fans, and having suction holes and discharge holes.

The fan cover includes a front surface portion to cover a front side of the driving fan and the driven fans, and having suction holes, and a peripheral wall surface portion extending from a circumference of the front surface portion to the rear wall of the cooking chamber to cover a periphery of the driving fan and the driven fans, and having discharge holes.

The suction holes are formed at the front surface portion in a front of the driving fan and the driven fans.

The fan cover further includes a flange portion extending outward from the peripheral wall surface portion adjacent with a rear wall of the cooking chamber.

The fan cover includes an approximately triangular shape, wherein the driving fan is located at a center of the fan cover and the plurality of driven fans are located at corners of the fan cover, respectively.

The cooking apparatus further includes at least one convection heater to heat air inside the cooking chamber.

The convection heater includes a single convection heater installed to surround only the driving fan.

The convection heater includes a single convection heater installed to surround the driving fan and the plurality of driven fans together.

The convection heater includes a plurality of convection heaters installed to surround the driving fan and the plurality of driven fans, respectively.

It is another aspect of the present invention to provide a cooking apparatus including a cooking chamber to cook food therein, a driving fan arranged at a rear wall of the cooking chamber, a convection heater arranged on a circumference of the driving fan, and a plurality of driven fans arranged adjacent to the driving fan, to rotate by air streams generated in accordance with an operation of the driving fan.

The cooking apparatus further includes a fan cover to cover the driving fan and the driven fans for allowing air streams, generated when the driving fan and the driven fans operate, to be evenly distributed and circulated into the cooking chamber.

A plurality of suction holes are perforated through a front surface portion of the fan cover to correspond to the driving fan and the plurality of driven fans, and a plurality of discharge holes are perforated through a peripheral wall surface portion of the fan cover to be spaced apart from one another by predetermined distances, whereby air inside the cooking chamber is introduced via the plurality of suction holes, so that it is heated by the convection heater inside the fan cover and is agitated by use of the driving fan and the driven fans, thereby being evenly distributed into the overall space of the cooking chamber via the plurality of discharge holes.

The cooking apparatus further includes upper and lower heaters mounted in upper and lower locations of the cooking chamber to operate simultaneously or independently with the convection heater received in the fan cover.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings of which.

DETAILED DESCRIPTION OF THE PREFERRED EMBODIMENTS

Figure 1:
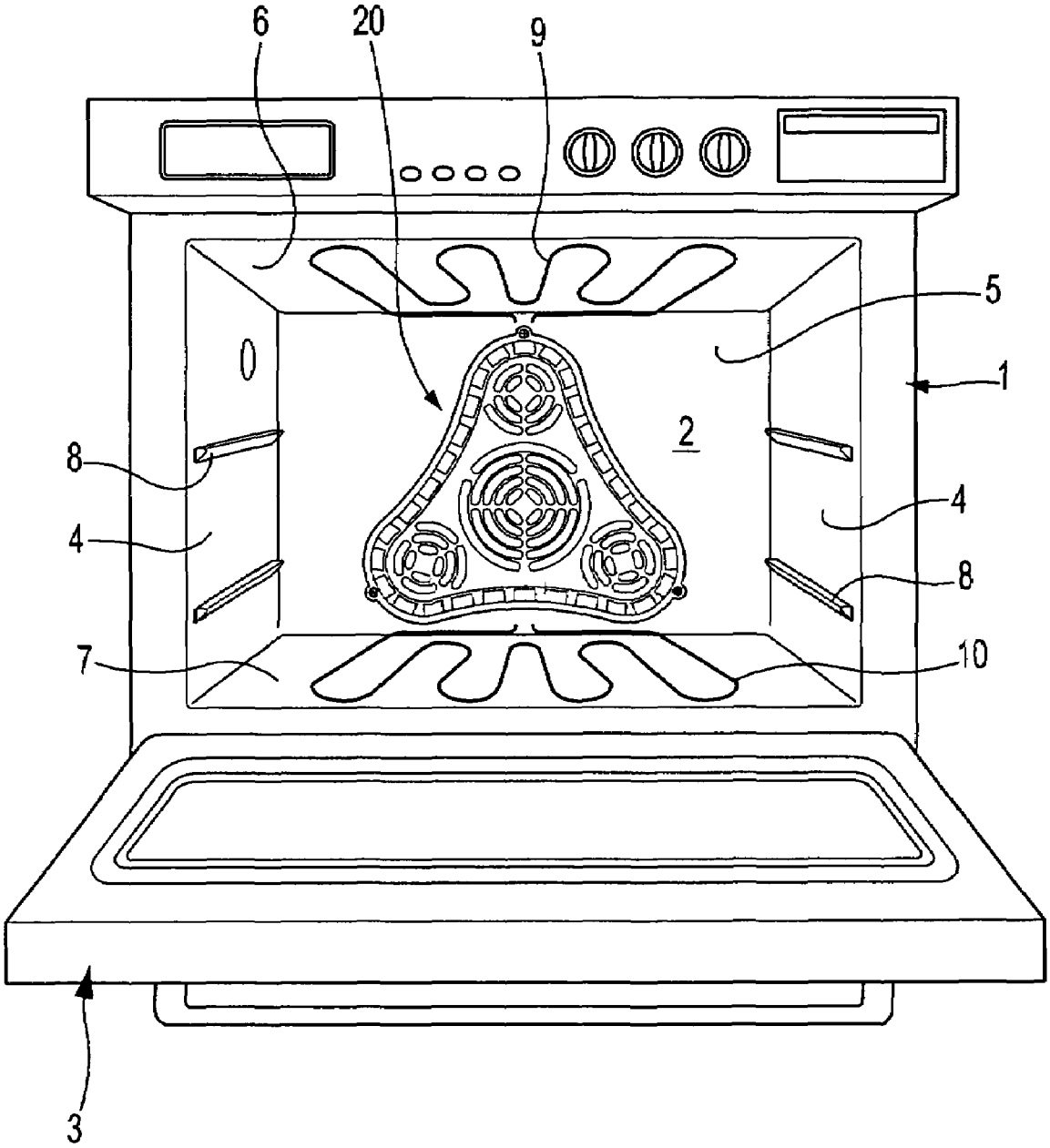
FIG. 1 is a front view illustrating a cooling apparatus in accordance with an embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

FIG. 1 is a front view illustrating a cooling apparatus in accordance with an embodiment of the present invention. As shown in FIG. 1, the cooking apparatus of the present invention comprises a housing 1 internally provided with a cooking chamber 2 having an open front side, and a door 3 hinged to the front side of the housing 1 to open or close the cooking chamber 2. The housing 1 and the door 3 form an outer appearance of the cooking apparatus.

A plurality of rails 8 are arranged on opposite side walls 4 of the cooking chamber 2 so that the rails 8 are vertically spaced apart from each other. The rails 8 serve to support racks (not shown), on which food to be cooked will be placed, so that the racks can be easily mounted to or separated from the rails 8. A convection device 20 is arranged at a rear wall 5 of the cooking chamber 2 to cook food in a convection-cooking manner.

An upper heater 9 and a lower heater 10 are mounted in upper and lower locations of the cooking chamber 2 adjacent to a top wall 6 and a bottom wall 7 of the cooking chamber 2, respectively. The upper and lower heaters 9 and 10 apply heat to upper and lower portions of food, so that the food is cooked in a grill-cooking manner.

When the convection device 20 is operated in a state wherein food is put on the rack that is supported at opposite ends thereof on the rails 8, air inside the cooking chamber 2 is introduced into the convection device 20 to be heated. The heated air is distributed into the overall space of the cooking chamber 2. A forced air circulation procedure is repeatedly performed, whereby the food is cooked in a convection-cooking manner. As the upper and lower heaters 9 and 10 are simultaneously or independently operated with the convection device 20, the surface of food is grilled and cooked.

Figure 2:
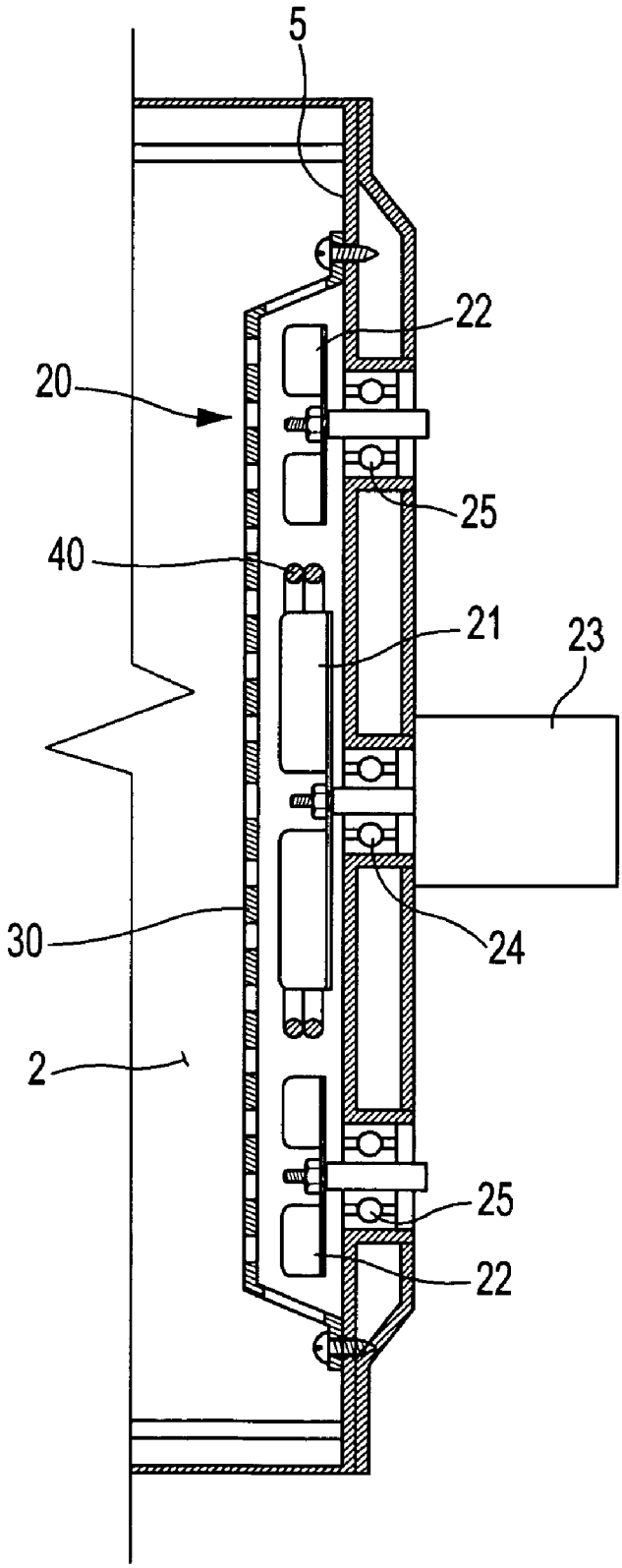
FIG. 2 is a sectional view illustrating an arrangement of a single driving fan and a plurality of driven fans provided in the cooking apparatus of FIG. 1.
Figure 3:
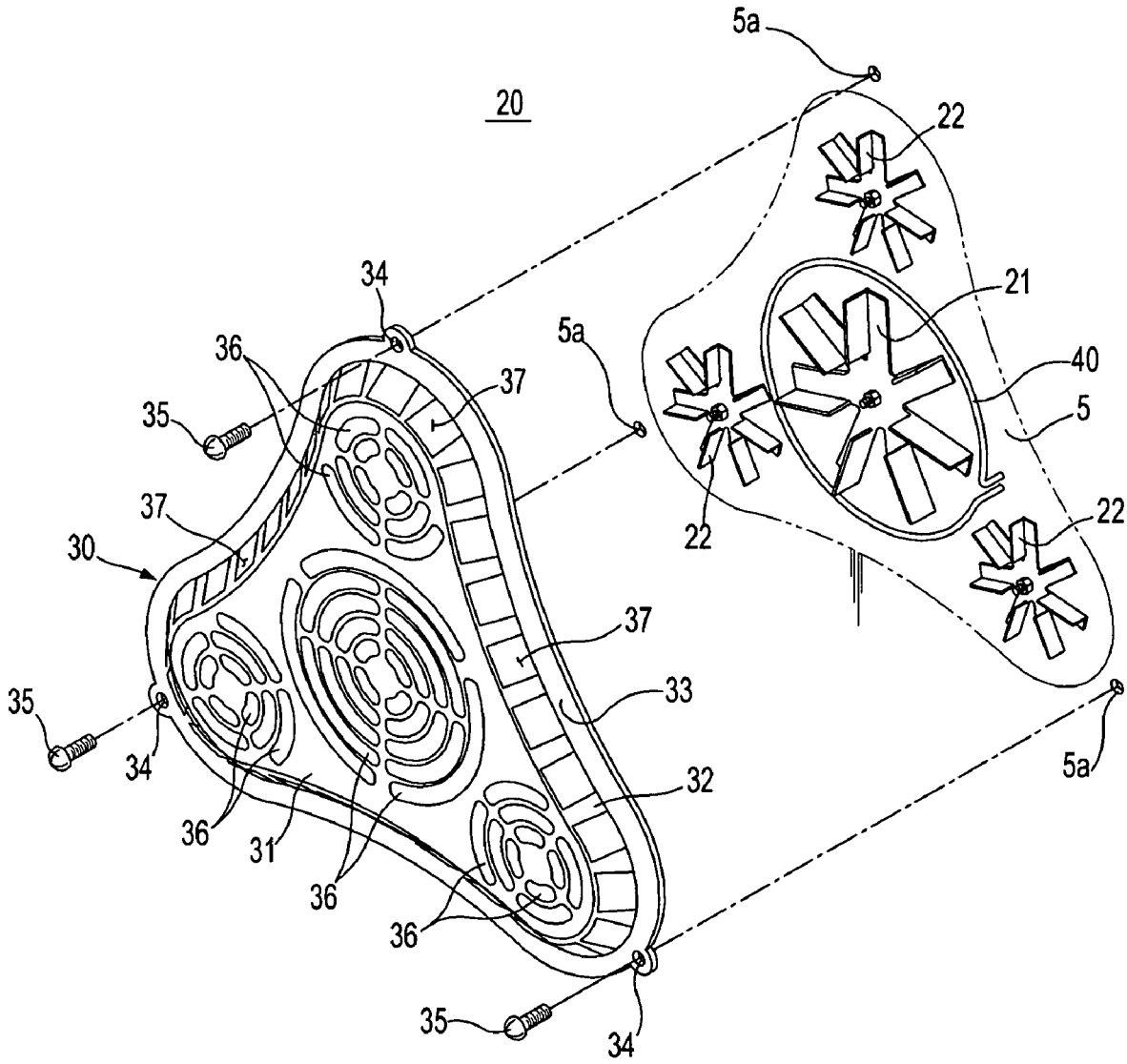
FIG. 3 is an exploded perspective view illustrating the driving fan and the driven fans, and a fan cover for covering the fans in accordance with an embodiment of the present invention.

FIGS. 2 and 3 illustrate the structure of the convection device 20 in accordance with an embodiment of the present invention. As shown in FIGS. 2 and 3, the convection device 20 of the present invention includes a driving fan 21 arranged at a center of the rear wall 5 of the cooking chamber 2, a plurality of driven fans 22 arranged along a circumference of the driving fan 21, and a fan cover 30 to cover the driving fan 21 and the driven fans 22.

The convection device 20 further comprises a convection heater 40 to surround a circumference of the driving fan 21 at a location adjacent to the driving fan 21. When the air inside the cooking chamber 2 is introduced into the fan cover 30, the air is heated to a high temperature, and simultaneously, is evenly agitated while passing through the driving fan 21, the convection heater 40, and the driven fans 22, thereby being again discharged into the cooking chamber 2, whereby the food can be cooked in a convection-cooking manner.

The driving fan 21 is connected with a drive motor 23 mounted at the outside of the rear wall 5 of the cooking chamber 2 while being rotatably supported by use of a bearing member 24. Thereby, the driving fan 21 is able to rotate at a high speed in accordance with an operation of the drive motor 23.

The plurality of driven fans 22, arranged around the driving fan 21, are rotatably supported by use of bearing members 25 mounted to the rear wall 5 of the cooking chamber 2, respectively. The driven fans 22 rotate at a lower speed than that of the driving fan 21 by the use of air streams generated when the driving fan 21 rotates.

The fan cover 30 comprises a front surface portion 31 to cover the front side of the driving fan 21 and the plurality of driven fans 22, a peripheral wall surface portion 32 extending from a circumference of the front surface portion 31 to the rear wall 5 of the cooking chamber 2 by a predetermined distance, and a flange portion 33 extending outward along a circumference of the peripheral wall surface portion 32 to contact the rear wall 5 of the cooking chamber 2.

The flange portion 33 and the rear wall 5 comprise a plurality of screw holes 34 and 5*a*, respectively, so that the fan cover 30 is fastened to the rear wall 5 of the cooking chamber 2 by use of a plurality of screws 35. Of course, instead of the screw-fastening method, other coupling methods, for example, welding, may be used to couple the fan cover 30 to the rear wall 5 of the cooking chamber 2.

A plurality of suction holes 36 are perforated through the front surface portion 31 of the fan cover 30 to correspond to the driving fan 21 and the respective driven fans 22. Also, a plurality of discharge holes 37 are perforated through the peripheral wall surface portion 32 of the fan cover 30 so that they are spaced apart from one another by predetermined distances along the overall circumference of the fan cover 30. By using the suction holes 36 and the discharge holes 37, the air inside the cooking chamber 2 is introduced into the fan cover 30, and is again discharged into the cooking chamber 2 in a forced circulation manner.

The fan cover 30 comprises an approximately triangular shape. The driving fan 21 is located to correspond to a center of the triangular fan cover 30, and the driven fans 22 are located to correspond to corners of the triangular fan cover 30, respectively. Thus, the fan cover 30 is provided with three driven fans 22, for example.

As an alternative, the fan cover 30 is not limited to any particular shape, and may comprise another shape, for example, a square, or a hexagonal shape, in accordance with a size and a shape of the cooking chamber 2.

The driving fan 21 comprises a plurality of blades having a predetermined length. Each of the plurality of driven fans 22 comprises a plurality of blades having a shorter length than that of the driving fan 21. Thus, the driven fans 22, smaller than the driving fan 21, are rotated by use of air streams generated when the driving fan 21 rotates at a high-speed, without using a separate drive motor. The flow of air in accordance with the rotation of the driving fan 21 and the driven fans 22 will be now explained with reference to FIG. 4.

Figure 4:
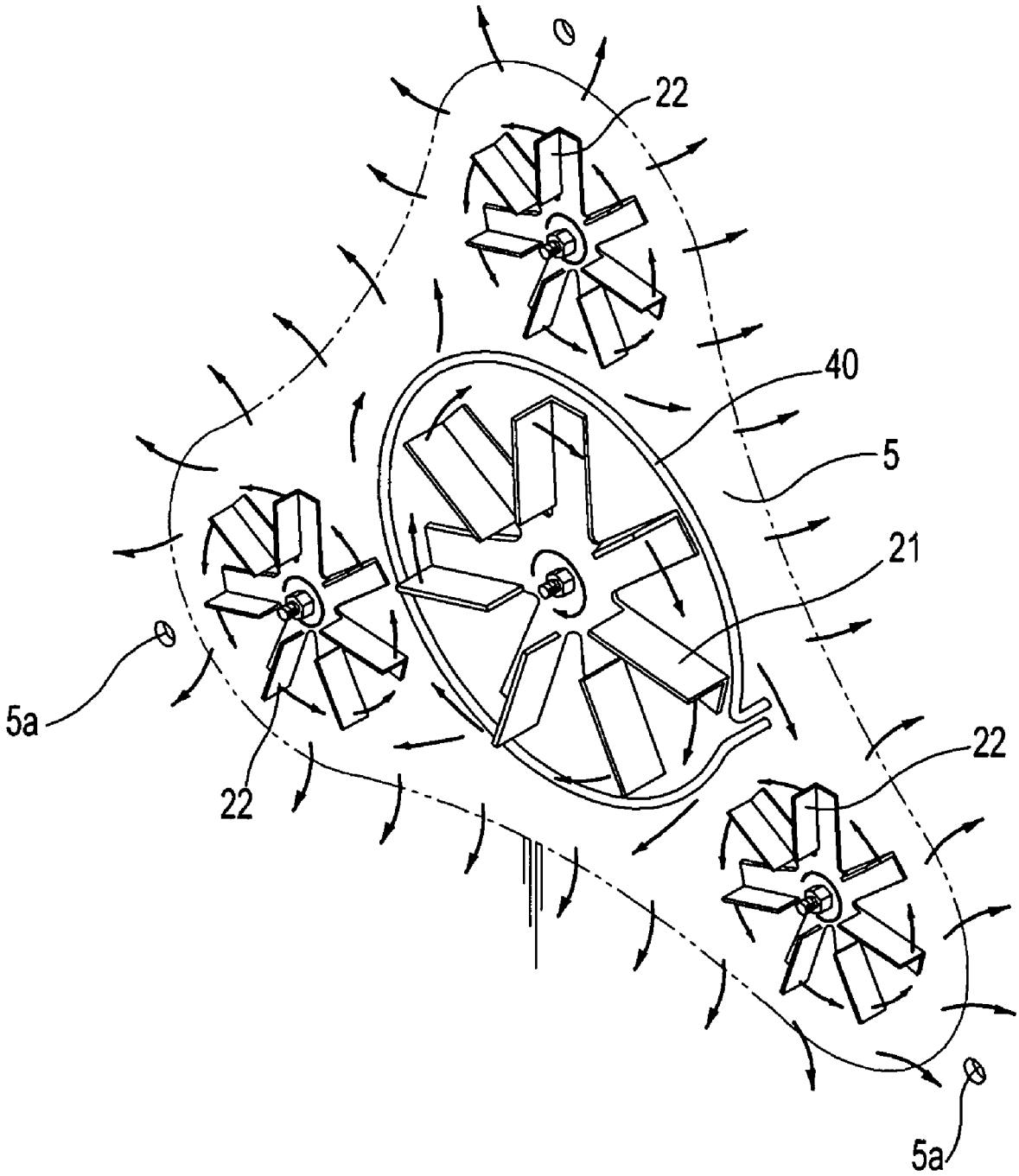
FIG. 4 is a perspective view illustrating a flow of air inside the fan cover, which is agitated by use of the single driving fan and the plurality of driven fans to thereby be discharged and distributed into a cooking chamber, a convection heater being installed to surround only the single driving fan in accordance with an embodiment of the present invention.

FIG. 4 is a view illustrating the flow of air, which is agitated by use of the single driving fan and the plurality of driven fans to thereby be discharged and distributed into the cooking chamber. As shown in FIG. 4, when the driving fan 21 rotates in a direction (FIG. 4 shows a clockwise rotation of the driving fan 21, for example) at a high speed in accordance with an operation of the drive motor 23, the air inside the cooking chamber 2 is axially introduced into the fan cover 30 via the suction holes 36. As the introduced air flows in a radial direction, the air is heated by the convection heater 40 surrounding the driving fan 21, thereby being changed into high-temperature air.

Subsequently, the high-temperature air, produced by the driving fan 21 and the convection heater 40, flows in a radial direction, causing the rotation of the driven fans 22. Specifically, the driven fans 22 rotate in a direction opposite to the rotating direction of the driving fan 21 (FIG. 4 illustrates a counterclockwise rotation of the driven fans 22, for example) at a lower speed than that of the driving fan 21. Thereby, the driven fans 22 operate to suction the air inside the cooking chamber 2 via the suction holes 36 arranged in front of the respective driven fans 22. Simultaneously, the driven fans 22 distribute the high-temperature air, flowing inside the fan cover 30, into all directions, allowing the high-temperature air, to be evenly agitated. Thus, the hot air having a constant temperature is evenly discharged via the discharge holes 37.

The hot air having a constant temperature, and having passed through the plurality of discharge holes 37 arranged along the circumference of the fan cover 30, flows in all directions along the rear wall 5 of the cooking chamber 2. Continuously, after passing through the opposite side walls 4, the top wall 6, and the bottom wall 7 of the cooking chamber 2 to reach the food placed in the center of the cooking chamber 2, the air is again introduced into the fan cover 30 via the suction holes 36. With the repetitive circulation of hot air, the food can be rapidly and evenly cooked.

In particular, since the convection device 20 is located at the center of the rear wall 5 of the cooking chamber 2, the air is introduced into the convection device 20 from the central portion of the cooking chamber 2, and is again discharged from the convection device 20 along the opposite side walls 4, the top wall 4, and the bottom wall 7, in a symmetrical circulation manner. This enables the food to be more evenly and rapidly cooked.

When the upper and lower heaters 9 and 10 are operated at the same time as the above-described convection cooking, the time necessary to cook the food can be shortened much more. Also, the upper and lower heaters 9 and 10 concentrate heat to the upper and lower portions of food, enabling the surface of food to be cooked in a grill cooking manner.

Although the above-described embodiment of the present invention exemplifies that the driving fan 21, the plurality of driven fans 22, and the fan cover 30 are mounted to the rear wall 5 of the cooking chamber 2, it should be noted that the present invention is not limited thereto, and as an alternative, the driving fan 21, the plurality of driven fans 22, and the fan cover 30 may be mounted to the opposite side walls 4, the top wall 6, or the bottom wall 7 of the cooking chamber 2.

Again, although the above-described embodiment of the present invention exemplifies that the fan cover 30 comprises an approximately triangular shape and the three driven fans 22 are arranged at the corners of the triangular fan cover 30, respectively, the present invention is not limited thereto. The fan cover 30 may comprise another shape, and three or more driven fans 22 may be arranged at the fan cover 30.

Figure 5:
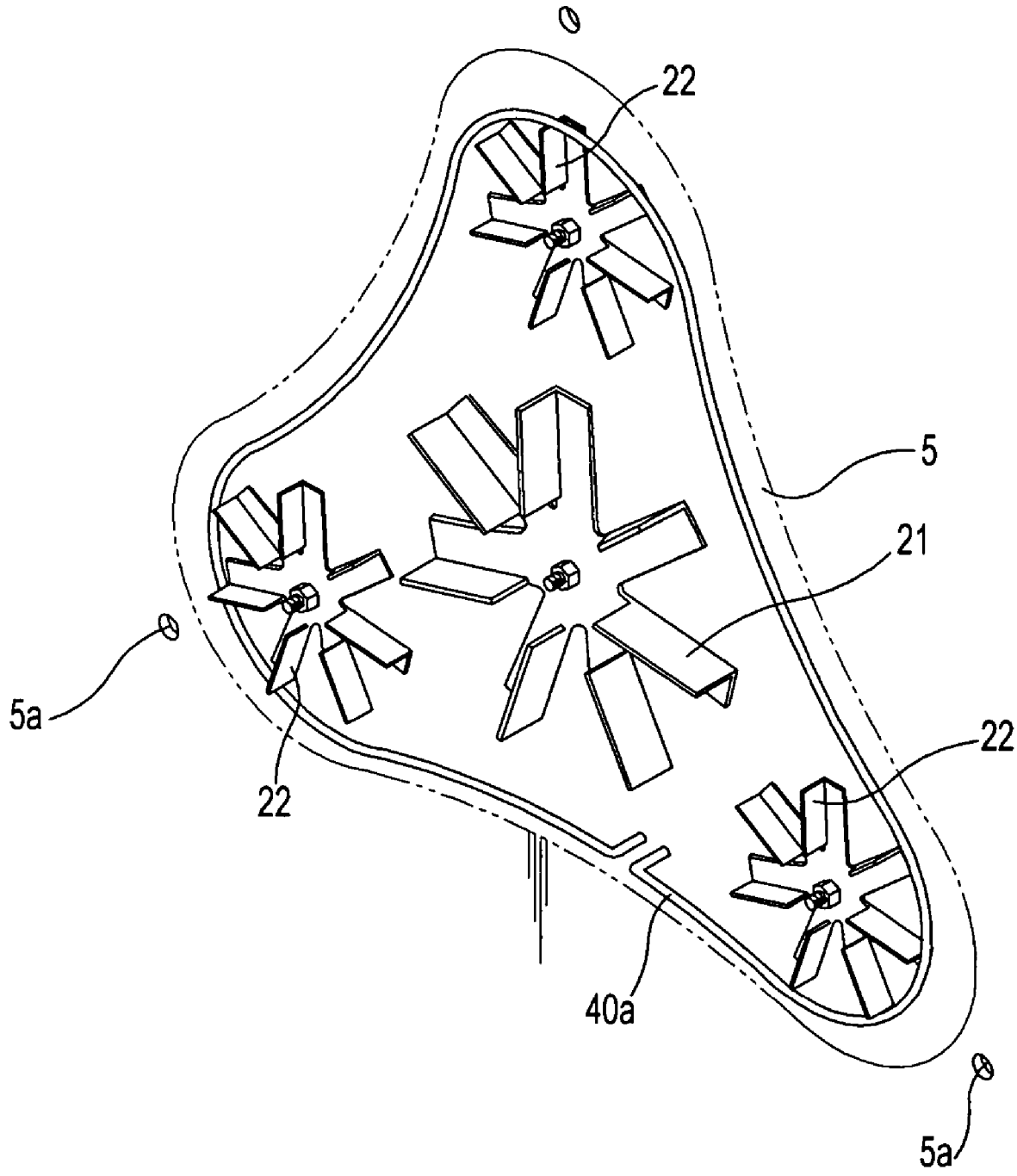
FIG. 5 is a view illustrating a convection heater in accordance with another embodiment of the present invention, which is installed to surround the plurality of driven fans around the driving fan.

FIG. 5 is a view illustrating a convection heater in accordance with another embodiment of the present invention, which is installed to surround the driving fan and the plurality of driven fans around the driving fan.

As shown in FIG. 5, when a convection heater 40*a* surrounds the plurality of driven fans 22 arranged around the driving fan 21, the convection heater 40*a* is able to heat air suctioned into the driven fans 21 as well as the driving fan 21 and to distribute the heated and agitated air into all directions of the cooking chamber 2.

Figure 6:
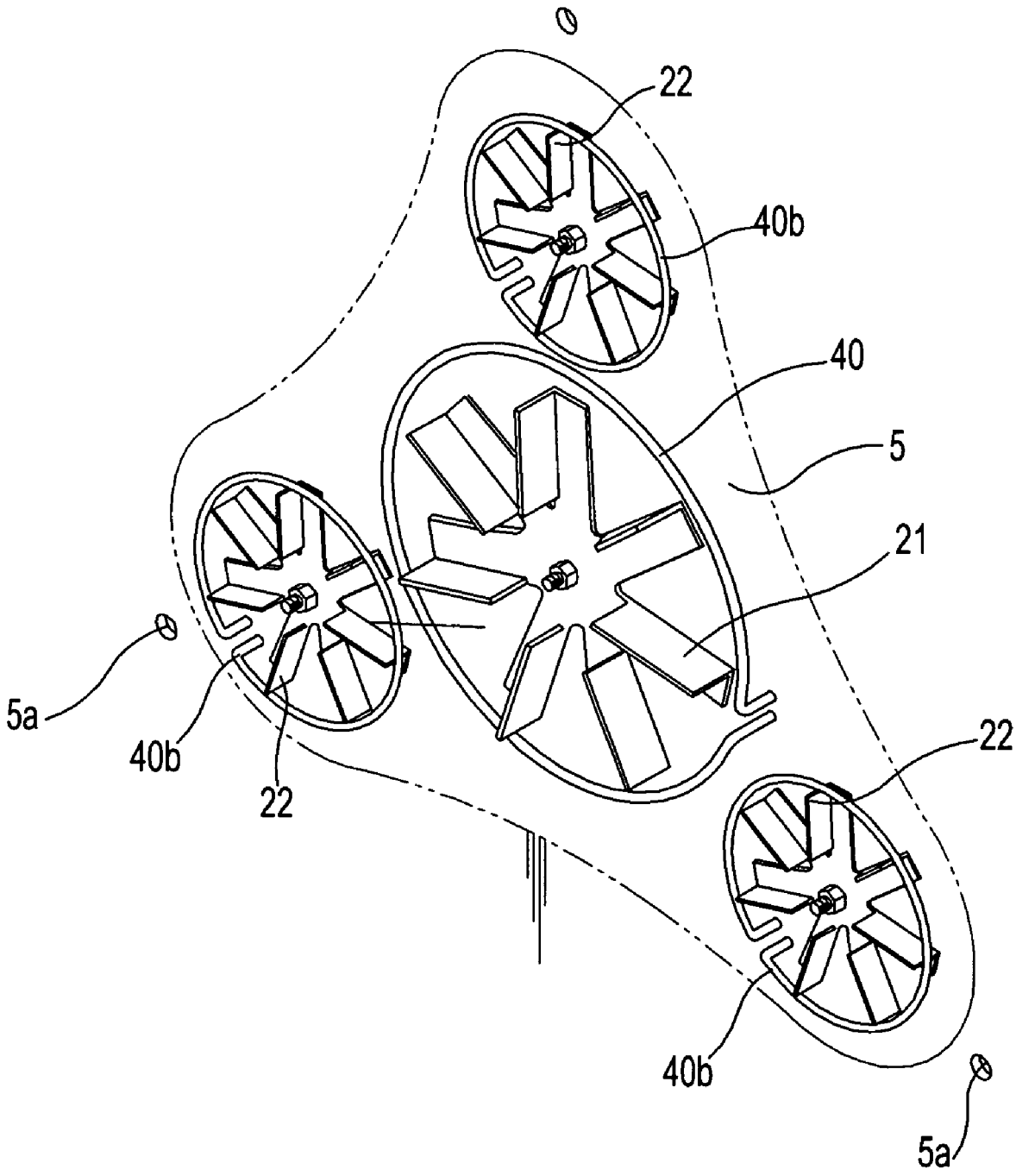
FIG. 6 is a view illustrating a plurality of convection heaters in accordance with another embodiment of the present invention, which are installed to surround the plurality of driven fans and the driving fan, respectively.

FIG. 6 is a view illustrating a plurality of convection heaters in accordance with another embodiment of the present invention, which are installed to surround the plurality of driven fans and the driving fan, respectively.

As shown in FIG. 6, in addition to the convection heater 40 to surround the driving fan 21, a plurality of convection heaters 40*b* are provided to surround the plurality of driven fans 22, respectively. In the present embodiment, after the air inside the cooking chamber 2 is suctioned into the driving fan 21 and is primarily heated by the use of the convection heater 40, the heated air is distributed in a radial direction, thereby being secondarily heated by the use of the plurality of convection heaters 40*b*. Simultaneously, the air inside the cooking chamber 2 is suctioned into the driven fans 22 and is primarily heated by the use of the convection heaters 40*b*. As the heated air is agitated, and is distributed into all directions of the cooking chamber 2, the food placed in the cooking chamber 2 can be rapidly and completely cooked by the use of the resulting hot air having a constant temperature.

As apparent from the above description, the present invention provides a cooking apparatus in which a single driving fan and a plurality of driven fans effectively agitates high-temperature air to evenly distribute the high-temperature air into the overall space of a cooking chamber, whereby food placed in the cooking chamber can be evenly cooked for a shortened cooking time with an improved cooking performance.

Further, according to the cooking apparatus of the present invention, the plurality of driven fans are operated by use of the single driving fan. Thus, the cooking apparatus allows for rapid cooking and reducing the consumption of energy.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus comprising:

a cooking chamber to cook food therein;

a driving fan arranged at a wall of the cooking chamber to rotate and to circulate air in the cooking chamber; and one or more driven fans arranged on a circumference of the driving fan such that when the driving fan rotates, the driven fans are rotated by use of air streams generated when the driving fan rotates without using a separate motor.

2. The cooking apparatus according to claim 1, wherein:

the driving fan is located at a center of a rear wall of the cooking chamber; and the driven fans are spaced apart from the driving fan by a predetermined distance.

3. The cooking apparatus according to claim 2, the cooking apparatus further comprises a drive motor installed at an outside of the rear wall of the cooking chamber, wherein the driving fan is connected with the drive motor to rotate in accordance with an operation of the drive motor; and the driven fans are supported at the rear wall of the cooking chamber by use of bearing members, respectively, to rotate by the air streams generated when the driving fan rotates.

4. The cooking apparatus according to claim 2, wherein the driven fans each comprise a plurality of blades of a shorter length than that of the driving fan.

5. The cooking apparatus according to claim 3, wherein the driven fans rotate in a direction opposite that of the driving fan.

6. The cooking apparatus according to claim 1, further comprising:

a fan cover to enclose the driving fan and the driven fans, and comprising suction holes and discharge holes.

7. The cooking apparatus according to claim 6, wherein the fan cover further comprises:

a front surface portion to cover a front side of the driving fan and the driven fans, and comprising the suction holes; and a peripheral wall surface portion extending from a circumference of the front surface portion to the rear wall of the cooking chamber, to cover a periphery of the driving fan and the driven fans, and comprising the discharge holes.

8. The cooking apparatus according to claim 7, wherein the suction holes are formed at the front surface portion in front of the driving fan and the driven fans.

9. The cooking apparatus according to claim 7, wherein the fan cover further comprises a flange portion extending outward from the peripheral wall surface portion to contact the rear wall of the cooking chamber.

10. The cooking apparatus according to claim 6, wherein the fan cover comprises an approximately triangular shape, wherein the driving fan is located at a center of the fan cover and the plurality of driven fans are located at corners of the fan cover, respectively.

11. The cooking apparatus according to claim 1, further comprising:

at least one convection heater to heat air inside the cooking chamber.

12. The cooking apparatus according to claim 11, wherein the convection heater comprises a single convection heater installed to surround only the driving fan.

13. The cooking apparatus according to claim 11, wherein the convection heater comprises a single convection heater installed to surround the driving fan and the plurality of driven fans together.

14. The cooking apparatus according to claim 11, wherein the convection heater includes a plurality of convection heaters installed to surround the driving fan and the plurality of driven fans, respectively.

15. A cooking apparatus comprising:

a cooking chamber to cook food therein;

a driving fan arranged at a rear wall of the cooking chamber;

a convection heater arranged on a circumference of the driving fan; and a plurality of driven fans arranged adjacent to the driving fan, to rotate by air streams generated in accordance with an operation of the driving fan.

16. The cooking apparatus according to claim 15, further comprising:

a fan cover to cover the driving fan and the driven fans for allowing air streams, generated when the driving fan and the driven fans operate, to be evenly distributed and circulated into the cooking chamber.

17. The cooking apparatus according to claim 16, further comprising:

a plurality of suction holes that are perforated through a front surface portion of the fan cover to correspond to the driving fan and the plurality of driven fans; and a plurality of discharge holes that are perforated through a peripheral wall surface portion of the fan cover to be spaced apart from one another by predetermined distances, whereby air inside the cooking chamber is introduced via the plurality of suction holes, so that it is heated by the convection heater inside the fan cover and is agitated by use of the driving fan and the driven fans, thereby being evenly distributed into the overall space of the cooking chamber via the plurality of discharge holes.

18. The cooking apparatus according to claim 16, further comprising:

upper and lower heaters mounted in upper and lower locations of the cooking chamber to operate simultaneously or independently with the convection heater received in the fan cover.

* * * * *